United States Patent [19]

Ozawa et al.

[11] Patent Number: 4,602,883

[45] Date of Patent: Jul. 29, 1986

[54] POWERED PAPER BAIL RELEASE AND PAPER FEEDING MECHANISM

[75] Inventors: Toshiaki Ozawa, Chiba; Hiroharu Nakajima, Kodaira; Hiroyuki Ueda, Kawasaki; Hiroatsu Kondo, Zushi; Yasuaki Yamada, Matsudo, all of Japan

[73] Assignee: Canon Kabushiki Kaisha, Tokyo, Japan

[21] Appl. No.: 597,555

[22] Filed: Apr. 6, 1984

Related U.S. Application Data

[63] Continuation of Ser. No. 356,024, Mar. 8, 1982, abandoned.

[30] Foreign Application Priority Data

Mar. 17, 1981 [JP] Japan ..... 56-37278
Mar. 17, 1981 [JP] Japan ..... 56-37279
Mar. 17, 1981 [JP] Japan ..... 56-37280

[51] Int. Cl.[4] ..... B41J 13/20

[52] U.S. Cl. ..... 400/637.1; 400/639.1; 400/639.2

[58] Field of Search ..... 400/637.1, 639.1, 639.2; 200/6 BB

[56] References Cited

U.S. PATENT DOCUMENTS 1,270,292 6/1918 Hess ..... 400/637.1
2,002,361 5/1935 Christian ..... 400/637.1 X
3,809,833 5/1974 Miller et al. ..... 200/6 BB
4,133,990 1/1979 Wanner et al. ..... 200/6 BB
4,211,499 7/1980 Hunt et al. ..... 400/639.1 X
4,266,880 5/1981 Buchanan ..... 400/639.1 X
4,275,969 6/1981 Matsuhisa et al. ..... 400/639.1 X

FOREIGN PATENT DOCUMENTS 0162677 12/1981 Japan ..... 400/639.1

OTHER PUBLICATIONS

IBM Technical Disclosure Bulletin, "Delayed Motion Cam-Actuated Switch", Kroeker, vol. 21, No. 9, Feb. 1979, pp. 3459-3460.

IBM Technical Disclosure Bulletin, "Paper-Insertion Apparatus for a Typewriter Having a First-Line Distance Option", Dobson et al., vol. 21, No. 10, Mar. 1979, pp. 4107-4108.

IBM Technical Disclosure Bulletin, "Automatic First Writing Line Mechanism", Sweat, Jr., vol. 23, No. 9, Feb. 1981, pp. 3961-3964.

Xerox Disclosure Journal, "Paper Bail Actuator", Kockler et al., vol. 4, No. 5, Sep./Oct. 1979, pp. 677, 678.

*Primary Examiner*—Ernest T. Wright, Jr.

*Attorney, Agent, or Firm*—Fitzpatrick, Cella, Harper & Scinto

[57] ABSTRACT

A paper feeding mechanism having a platen is driven by power from a drive source and clamps a recording paper sheet with paper holding rollers and pinch rollers so as to feed the recording paper sheet along the paper guide. When the recording paper sheet is loaded, a lever serves to separate the paper holding rollers from the platen. When a microswitch detects the operation of the lever, the platen is automatically rotated by a predetermined amount.

5 Claims, 5 Drawing Figures

POWERED PAPER BAIL RELEASE AND PAPER FEEDING MECHANISM

This application is a continuation of application Ser. No. 356,024 filed Mar. 8, 1982, now abandoned.

BACKGROUND OF THE INVENTION

1. Field of the Invention

The present invention relates to a paper feeding mechanism and, more particularly, to a paper feeding mechanism used for a typewriter or a printer with rotating means such as a platen on the driving side and holding means such as a paper holding roller.

2. Description of the Prior Art

Recently introduced typewriters and various printers are electronically controlled and driven. The operator can use them easily. However, the operator must perform substantially the same manual operations as in a mechanically operated typewriter or printer. Specifically, alignment of a recording paper sheet with the initial printing position is very cumbersome. In particular, the recording paper sheet is placed in a predetermined position relative to a platen. The platen is then rotated so as to feed the recording paper sheet. Paper holding rollers are separated from the platen and the recording paper sheet is guided between the platen and the paper holding rollers. Then, the paper holding rollers are returned to the original position so as to bring them into contact with the paper sheet P on the platen. This manual operation must be repeated every time the recording paper sheet is loaded, resulting in inconvenience.

SUMMARY OF THE INVENTION

It is an object of the present invention to provide an automatic paper feeding mechanism.

It is another object of the present invention to provide a feeding mechanism for automatically setting a recording paper sheet at a proper position.

It is still another object of the present invention to provide a paper feeding mechanism with a simple structure.

It is still another object of the present invention to provide a paper feeding mechanism wherein holding means abuts against rotating means or is separated therefrom by a motor and a cam member.

It is still another object of the present invention to provide a paper feeding mechanism having single detecting means for detecting timing of paper feeding and one cycle of operation of the separating means.

It is still another object of the present invention to provide a paper feeding mechanism wherein a plurality of holding means abut against the rotating means or are separated therefrom with a one-touch operation.

The other objects, features and advantages of the present invention will be apparent from the following description when taken in conjunction with the accompanying drawing.

DETAILED DESCRIPTION OF THE PREFERRED EMBODIMENTS

Figure 1:
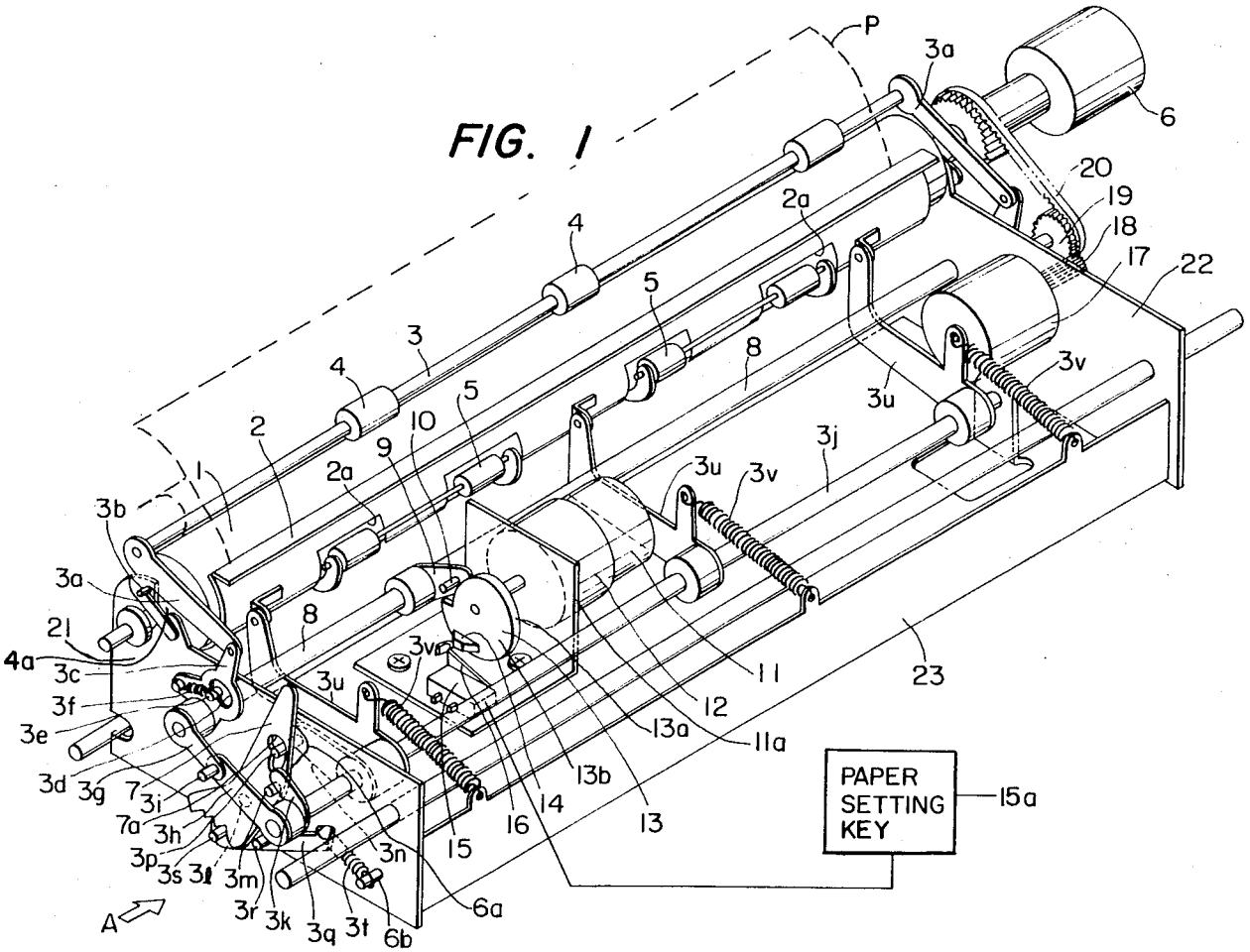
FIG. 1 is a front perspective view showing the overall structure of a feeding mechanism according to one embodiment of the present invention.

FIG. 1 shows the main part of a printer which incorporates the feeding mechanism of the present invention. A platen 1 as rotating means on the driving side is driven by a paper feed motor 17 as the drive source. A paper guide 2 extends to the front side of the platen 1 so as to partially surround the platen 1. A shaft 3 is disposed above the platen 1 and is parallel thereto. Both ends of the shaft 3 are supported by levers 3*a*. A plurality of paper holding rollers 4 are defined as first holding means for holding a recording paper sheet P on the platen 1 and are rotatably mounted on the shaft 3. A knob 6 for manually feeding the recording paper sheet P is fixed at one end of the platen 1. A plurality of openings 2*a* are formed in the paper guide 2. A plurality of pinch rollers 5 which are defined as second holding means are rotatably mounted in the openings 2*a* of the paper guide 2, respectively. The pinch rollers 5 are pivotally urged toward and are always in contact with the platen 1.

A notched portion 4*a* of the lever 3*a* is engaged with a pin 3*b*. Both levers 3*a* are slidably and pivotally supported by side plates 21 and 22, respectively. An end of the lever 3*a* is pivotally coupled with an upper end of a lever 3*c*. As is apparent from FIGS. 1 and 2, the lever 3*c* is fixed on one end of a shaft 8 which is pivotally supported by the side plates 21 and 22. A pin 3*e* mounted on the side plate 21 extends through an arcuated elongate hole 3*d* formed at the center of the lever 3*c*. A spring 3*f* is hooked across the pin 3*e* and the other end of the lever 3*c* so as to urge the lever 3*c* in the clockwise direction in FIG. 2. This urging force acts so that the paper holding rollers 4 come in contact with the platen 1.

One end of a lever 3*g* is fixed to the shaft 8 and located outside the lever 3*c*. A free end of the lever 3*g* is in contact with a pin 3*i* mounted at one end of a lever 3*h*. The lever 3*h* is pivotally supported at one end of a rotatable shaft 3*j* extending between the side plates 21,22. A lever 3*k* which is located inside the lever 3*h* is pivotally mounted integrally therewith on the rotatable shaft 3*j*. A lever 7 which is located inside the lever 3*k* is pivotally supported on a pin 3*l* extending from the side plate 21. The bottom of the lever 3*k* is in contact with a pin 3*m* extending from the side surface of the lever 7.

An arcuate elongate hole 7*a* is formed in the vicinity of the upper end of the lever 7. A pin 3*p* which is mounted at the top of a lever 3*n* fixed on the rotatable shaft 3*j* is fitted in the arcuated elongate hole 7*a* and extends through an elongate hole 6*a* formed in the side plate 21. Further, a lever 3*q* is supported at a pin 3*r* extending from the side plate 21 to be rotatable with respect to the side plate 21. A pin 3*s* mounted on one end of the lever 3*q* is engaged with a stepped portion 7*b* of the lower end of the lever 7. A spring 3*t* is hooked across the other end of the lever 3*q* and a pin 6*b* mounted on the side plate 21 so as to urge the lever 3*q* in the clockwise direction in FIG. 2.

One end of each of a plurality of arms 3*u* is mounted on the rotatable shaft 3*j*. The other end of each of the plurality of arms 3*u* is pivotally coupled to the paper guide 2. A spring 3*v* is hooked across a projection of each of arms 3*u* and a frame 23 fixed between the side plates 21 and 22. Thus, the force acts so as to cause the paper guide 2 to butt against the platen 1.

Figure 2:
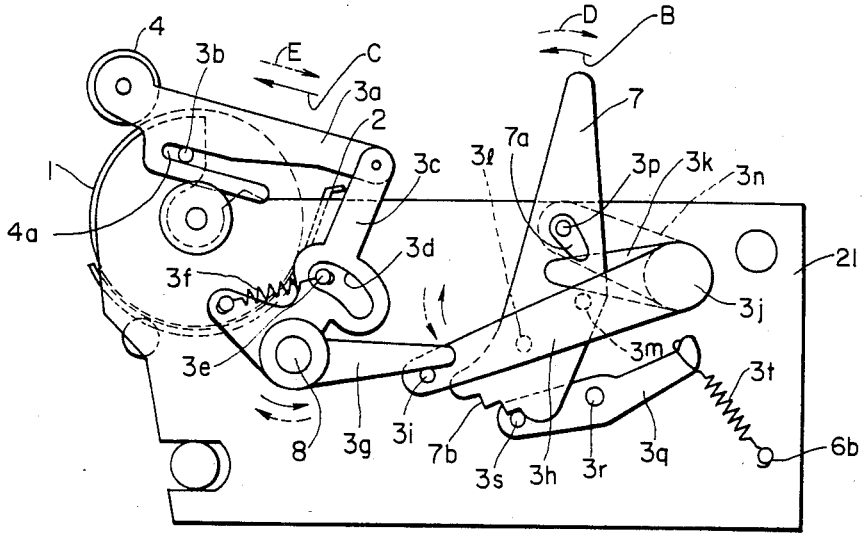
FIGS. 2 to 4 are side views of the feeding mechanism, viewed from the direction indicated by arrow A in FIG. 1, for explaining the mode of operation of the feeding mechanism.

With the above construction, the lever 7 acts as manual separating means for separating the paper holding rollers 4 and the pinch rollers 5 from the platen 1 and for bringing the paper holding rollers 4 and the pinch rollers 5 into contact with the platen 1 again. A link mechanism comprising levers 3*k*, 3*h*, 3*g*, 3*c* and 3*a* controls the abutment and separation of the paper holding rollers 4. On the other hand, another link mechanism comprising the levers 3*n* and 3*u* controls the abutment and separation of the pinch rollers 5. The pivotal direction of the lever 7 and the moving direction of the levers 3*k* and 3*a* are shown in FIG. 2. When the lever 7 is pivoted in the direction indicated by the solid line arrow B, the lever 3*a* is moved in the direction indicated by the solid line arrow C. Therefore, the paper holding rollers 4 are separated from the platen 1. On the other hand, when the lever 7 is pivoted in the direction indicated by the broken line arrow D, the lever 3*a* is moved in the direction indicated by the broken line arrow E and the paper holding rollers 4 come into contact with the platen 1.

Further, when the lever 7 is pivoted in the direction indicated by the solid line arrow B, the levers 3*u* are pivoted in the counterclockwise direction in FIG. 1. Thus, the pinch rollers 5 are separated from the platen 1.

A lever 9 is mounted on the shaft 8 and a pin 10 is mounted at the top of the lever 9.

A DC motor 11 as the drive source is mounted in the vicinity of the lever 9 on a frame portion 11*a* of the printer so as to butt the paper holding rollers 4 against the platen 1 and to separate the paper holding rollers 4 from the platen 1 by a mechanism to be described later. A cam 13 is connected to the DC motor 11 through reduction gears 12 integrally mounted therewith. Thus, the means for butting the paper holding rollers 4 against the platen 1 and for separating them from the platen 1 is constituted by the DC motor 11, the reduction gears 12 and the cam 13. The cam 13 is substantially disc shaped and has a first cam face 13*a* on the circumference thereof and a projection 14 on the side surface substantially perpendicular to the first cam face 13*a*. The side surface including the pivotal path of the projection 14 forms a second cam face 13*b*. The first cam face 13*a* has a step in the radial direction of the cam 13 so as to form the cam 13 in the shape of a spiral turn.

The cam 13 is located so as to come in contact with the pin 10. Since the shaft 8 and the pin 10 mounted thereon are urged by the spring 3*f* in the clockwise direction in FIG. 1, the pin 10 is always in contact with the circumferential surface of the first cam face 13*a* when the cam 13 is operated.

A microswitch 15 as the means for detecting the rotating position of the cam 13 has an actuator 16. The actuator 16 is located in contact with the second cam face 13*b* so as to be separated from and in contact with the projection 14. Thus, the microswitch 15 is turned on and off. Normally, the projection 14 keeps depressing the actuator 16 and the microswitch 15 is in the off state. When the microswitch 15 is turned on, the paper feeding motor 17 starts rotating so as to rotate the platen 1 through gears 18 and 19 and a belt 20. The leading end of the recording paper sheet P is guided through a space between the platen 1 and the paper holding rollers 4. The microswitch 15 is turned on when a paper setting key 15*a* or the like is depressed to start rotating the DC motor 11 and therefore the cam 13 and to release the projection 14 from the actuator 16, in a manner to be described in detail later. The paper holding rollers 4 are slightly separated from the platen 1 by the rotation of the cam 13 through a link mechanism which comprises the levers 9, 3*c* and 3*a*. The paper holding rollers 4 need not be apart from the platen 1 when the microswitch 15 is turned on. It suffices that the paper holding rollers 4 be separated from the platen 1 sufficiently before the leading end of the recording paper sheet P is fed with rotation of the platen 1 to the paper holding rollers 4.

Therefore, the microswitch 15 detects whether the separating means is operated. When it detects that the separating means is operated, the microswitch 15 serves to initiate feed of the recording paper sheet P. When the cam 13 revolves once, the microswitch 15 is actuated to the off state again. Thus, the DC motor 11 stops rotating. In other words, when the microswitch 15 detects one revolution of the cam 13, that is, one cycle of the operation of the separating means, the DC motor 11 stops rotating. That is, the operation of the separating means is interrupted by the detection of the microswitch 15.

The mode of operation of the paper feeding mechanism with the above structure will now be described.

Immediately before the paper feeding mechanism is operated, the paper holding rollers 4 mounted on the shaft 3 are in tight contact with the platen 1. The pin 10 is apart from the cam 13. The projection 14 is in contact with the actuator 16. Further, the microswitch 15 is in the off state.

Figure 3:
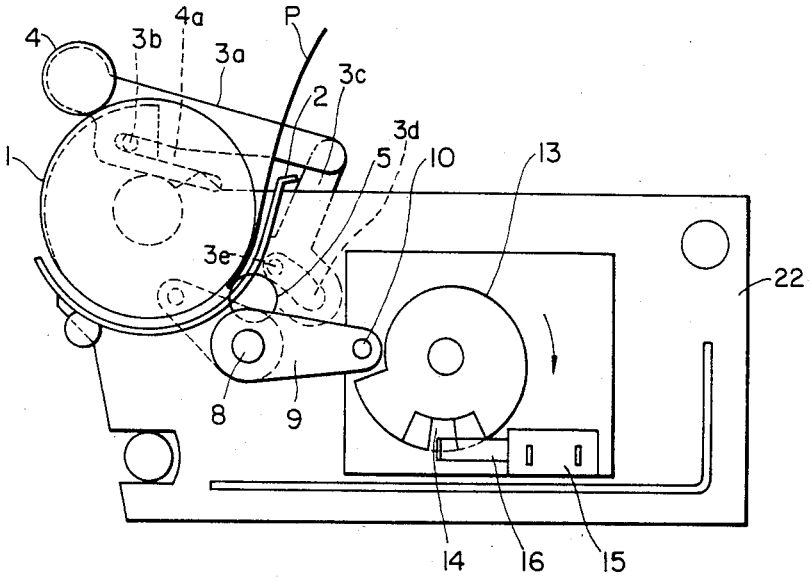
Figure 5:
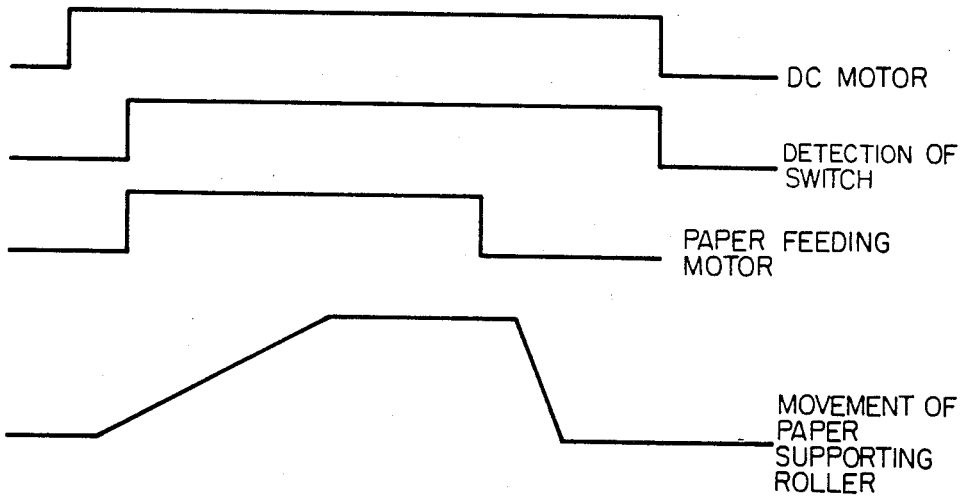
FIG. 5 shows timing charts at the main parts of the feeding mechanism.

In this condition, as shown in FIG. 3, the sheet of recording paper P is guided between the platen 1 and the paper guide 2. The leading end of the sheet of the recording paper P abuts against the contact positions between the pinch rollers 5 and the platen 1. When the paper setting key 15*a* is depressed, the DC motor 11 starts rotating, as shown in FIG. 5. Simultaneously, the cam 13 starts rotating. With rotation of the cam 13, the pin 10 is moved on the circumference of the large diameter portion of the first cam face 13*a*. Therefore, the shaft 8 is pivoted in the counterclockwise direction in FIG. 3. Further, the lever 3*c* is also pivoted in the counterclockwise direction against the biasing force of the spring 3*f*. The lever 3*a* slides along the pin 3*b* in the direction indicated by the solid line arrow C in FIG. 2. The paper holding rollers 4 are separated from the platen 1.

Figure 4:
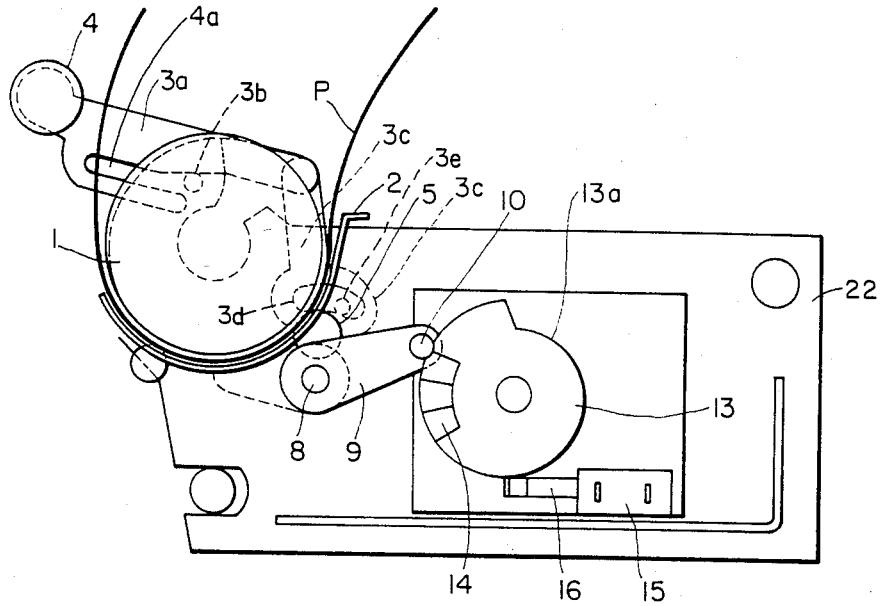

When the projection 14 of the cam 13 is released from the actuator 16, the microswitch 15 is turned on, as shown in FIG. 5. Simultaneously, the paper feeding motor 17 is turned on. The platen 1 is rotated in the clockwise direction in FIG. 3. The sheet of recording paper P located between the platen 1 and the pinch rollers 5 is guided along the paper guide 2 by the frictional force. As is apparent from the timing charts of FIG. 5, the paper holding rollers 4 are gradually separated from the platen 1 and a large space is formed therebetween. Thus, the leading end of the recording paper P is guided between the paper holding rollers 4 and the platen 1, as shown in FIG. 4. The amount by which the paper sheet P is fed is predetermined. When the paper feeding motor 17 is rotated for a predetermined period of time to feed the paper sheet P by the predetermined amount, the projection 14 comes in contact with the actuator 16 again. Therefore, the microswitch 15 is actuated to the off state and the DC motor 11 simultaneously stops rotating.

On the other hand, as is apparent from FIG. 4, with rotation of the cam 13, the pin 10 comes in contact with the circumference of the decreasing diameter portion of the first cam face 13*a* so that lever 3*a* is slid in the direction indicated by the broken line arrow E in FIG. 2. The paper holding rollers 4 which come into tight contact with the platen 1 thereby clamp the leading end of the sheet of recording paper P therewith.

As described above, the sheet of recording paper P is fed to a predetermined position by inserting the sheet of recording paper P to the contact positions between the pinch rollers 5 and the platen 1 and by depressing the paper setting key 15*a*. Thus, the sheet of recording paper P is automatically set at the initial printing position.

What we claim is:

1. A mechanism for feeding a recording paper sheet, comprising:

first rotatable means for feeding a recording paper sheet;

first and second holding means, independent of each other, each for holding a recording paper sheet against said first rotatable means so that the recording paper sheet may be fed by rotation of said first rotatable means, said second holding means remaining in contact with said first rotatable means during operation of the mechanism;

second rotatable means including a motor and a cam member connected for rotation by said motor and having a first cam surface and a second cam surface wherein said second cam surface has a face comprising a first rotating region and a second rotating region for indicating the rotational position of said second rotatable means;

generating means for generating an instruction to actuate said motor and initiate operation of the mechanism:

separating means including a first linkage having a first lever assembly with a first end thereof engaging said first cam surface and, a second end thereof secured to a first rotatable shaft; a second lever assembly with a first end thereof secured to said first rotatable shaft and, a second end thereof connected to said first holding means; said first linkage being responsive to rotation of said cam member for separating said first holding means from said first rotatable means and thereafter for returning said first holding means to a position to hold the recording paper sheet against said first rotatable means;

a second linkage having a third lever assembly with a first end thereof secured to said first rotatable shaft, and a second end thereof secured to a second rotatable shaft;

a fourth lever assembly having a first end thereof secured to said second rotatable shaft;

detecting means for detecting the position of said face (a) to cause said first rotatable means to start rotation when said face of said cam member changes its position from said first rotating region to the second rotating region and (b) to stop the rotation of said motor and terminate operation of the mechanism when said face changes its position from the second rotating region to the first rotating region;

means for manually separating said first and second holding means from said first rotatable means including a fifth lever assembly engaging a second end of said fourth lever assembly;

a sixth lever assembly including a pin secured in a first end thereof for engaging an elongate hole in said fifth lever assembly, said sixth lever assembly being secured at a second end thereof to said second rotatable shaft; and a seventh lever assembly having a first end thereof secured to said second shaft and, a second end thereof connected to said second holding means;

wherein said means for manually separating said first and second holding means from said first rotatable means functions independently, said means for manually separating being movable to (i) a first position for holding said first and second holding means against said first rotatable means; (ii) a second position for separating only said first holding means from said first rotatable means; and (iii) a third position for separating said first and second holding means from said first rotatable means, wherein the operation of said manual separating means does not prevent the operation of said rotatable means.

2. A mechanism for feeding a recording paper sheet according to claim 1, wherein said first cam surface is on a circumference of said cam member for cooperating with said first linkage and said second cam surface is substantially perpendicular to said first cam surface, said detecting means detecting the rotational position of said cam member by interaction with said second cam surface.

3. A mechanism for feeding a recording paper sheet according to claim 2, wherein said first cam face is shaped to separate said first holding means from said first rotatable means through said first linkage upon rotation of said cam member and, thereafter, to cause said first holding means to butt against said first rotatable means.

4. A mechanism for feeding a recording paper sheet according to claim 3, wherein said first cam face has a step in a radial direction of said cam member.

5. A mechanism for feeding a recording paper sheet according to claim 1, wherein said motor runs continuously during the operating cycle of the mechanism.

* * * * *